United States Patent [19]

Snyder

[11] Patent Number: 4,934,325

[45] Date of Patent: Jun. 19, 1990

[54] ROTARY INTERNAL COMBUSTION ENGINE

[76] Inventor: Duane P. Snyder, 50241 8th Ave., Grand Junction, Mich. 49056

[21] Appl. No.: 288,879

[22] Filed: Dec. 23, 1988

[51] Int. Cl.[5] ..... F02B 53/00

[52] U.S. Cl. ..... 123/246; 418/196

[58] Field of Search ..... 123/241, 246; 418/196

[56] References Cited

U.S. PATENT DOCUMENTS

| | | | |
|---|---|---|---|
| 710,756 | 10/1902 | Colbourne | 418/196 X |
| 1,349,882 | 8/1920 | Homan | 418/196 |
| 2,097,881 | 11/1937 | Hopkins | 418/196 X |
| 3,809,026 | 5/1974 | Snyder | 418/196 X |

FOREIGN PATENT DOCUMENTS

| | | | |
|---|---|---|---|
| 938224 | 1/1956 | Fed. Rep. of Germany | 123/246 |
| 2415406 | 10/1974 | Fed. Rep. of Germany | 418/196 |
| 2429376 | 1/1976 | Fed. Rep. of Germany | 418/196 |
| 8521 | 4/1969 | Japan | 123/246 |

*Primary Examiner*—Michael Koczo
*Attorney, Agent, or Firm*—Austin A. Webb

[57] ABSTRACT

Four adjacent parallel rotors of elliptical cross section have hollow interior flow passages communicating through hollow supporting shafts at one end. The supporting shafts at the opposite ends of the rotors have eccentric crank pins received in bearing holes in a common connecting block which orbits as the rotors rotate in unison. One of the shafts extends beyond the crank block as a drive shaft. Each rotor has a second flow passage opening through its surface adjacent to one apex of its major axis. A first pair of these flow passages, in diametrically opposed rotors, open in trailing relation to apices of the two rotors. The other pair of rotors has secondary flow passages through their surfaces in leasing relation to the apices of the latter two rotors.

10 Claims, 4 Drawing Sheets

ROTARY INTERNAL COMBUSTION ENGINE

This invention relates to improvements in a Rotary Vane Internal Combustion Engine.

The invention resides in improved arrangement of parts similar to those shown in my Pat. No. 3,809,026.

BACKGROUND OF THE INVENTION

Prior art engines have utilized elongated co-acting rotors of elliptical cross section to define combustion chambers that expand and contract as they rotate in unison. Hollow rotors with hollow supporting shafts have been used, with inlet ports formed through the sides of part of the rotors, and outlet ports formed through others of the rotors. Other engines have circulated cooling liquid through hollow rotors.

SUMMARY OF THE INVENTION

Applicant utilizes hollow rotors of similar exterior contour and having hollow shafts on one end. A casing encloses the rotors in spaced relation. Crank pins on the opposite end of the rotor shafts engage a common crank block which causes the rotors to rotate in unison. Parts of the rotors are continually supplied with air from a blower, and alternate rotors have their shafts connected to an exhaust. The first of these rotors have inlet ports formed through the trailing sides of one of their apexes and the other rotors have outlet ports formed through the leading edges of one of their apexes, so incoming air passes first through the first rotors, then through the casing and then into the alternate rotors to reach the combustion chamber. All of the rotors are thus cooled by incoming air. Elliptical conical rings in the ends of the rotors seal against end plates to seal the combustion chamber.

DETAILED DESCRIPTION

The drawings, of which there are four sheets, illustrate a preferred form of the invention.

Figure 3:
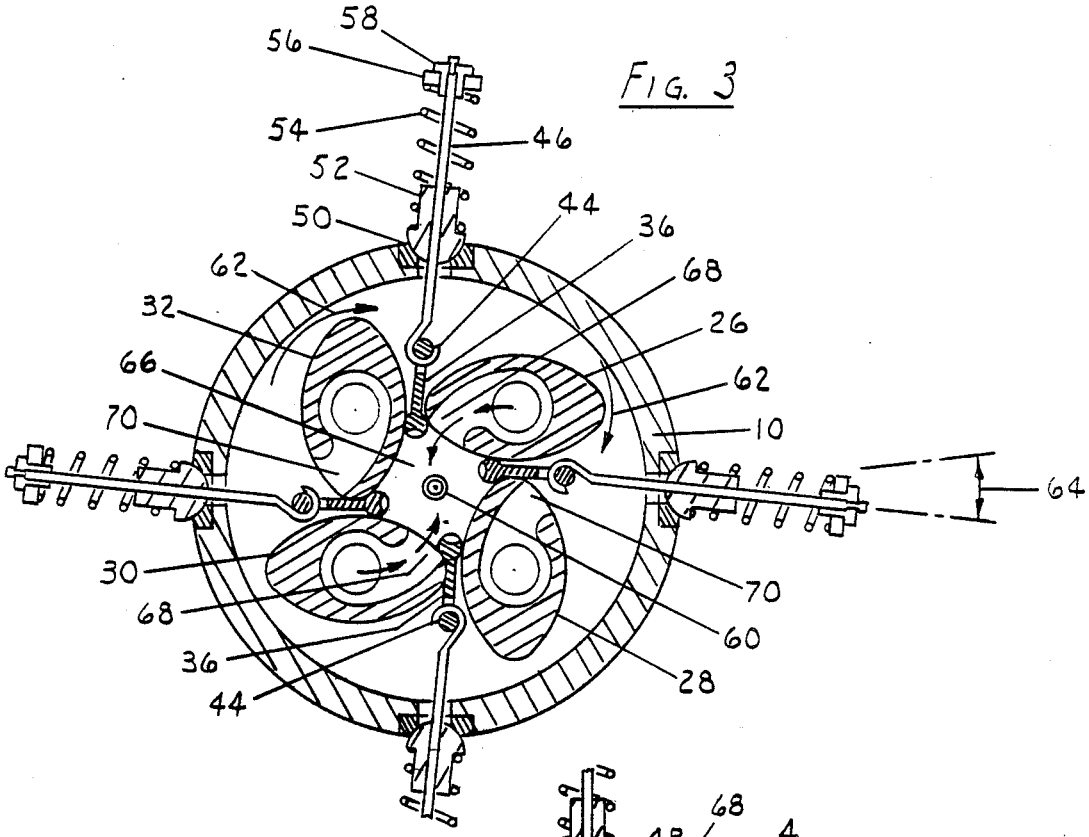
FIG. 3 is a transverse cross sectional view through the engine taken along the plane of the line 3—3 in FIG. 1 and looking in the direction of the arrows.

The body of the engine consists of a cylindrical mid-section 10 connecting between two circular end plates 12 and 14. Each end plate has four rectangularly spaced bearing holes 16 that are co-axial with the bearing holes in the other end plate. A cylindrical crank case extension 18 is formed integrally on the outside of end plate 14 and supports a cover plate 20 with an outboard bearing 22 for the end of a drive shaft 24 to be described. Within the mid-section 10 are four elongated rotors of elliptical cross section with shafts at each end journalled in the end plates. The rotors are identified in clockwise progression around FIG. 3 as 26, 28, 30 and 32. The ends of the shafts journalled in plate 12 are hollow and form intake and exhaust passages, also to be described presently. The shafts within the crank case extension 18 have crank pins 34 thereon with the pins on the shafts of rotors 26 and 30 appearing in FIG. 4. Drive shaft 24 is an extension of the shaft on rotor 26. The perspective view of rotor 26 in FIG. 3 is rotated 100 degrees from the position shown in FIG. 4.

Fitted in sliding contact between each adjacent pair of rotors is an elongated separator seal 36 with a cylinder-like bead 38 on its inner edge that extends co-extensively along the sides of the rotors. The inner faces of the beads have slanted concave grooves 40 and the exterior surfaces of the beads are cylindrically convex. The seals taper along their radially outer edges and have holes 42 therethrough which receive the hooked inner ends 44 on the inner ends of tension rods 46 which project through holes 48 formed through diametrically opposed sides of the cylindrical mid-section 10 of the body of the engine. Hemispherical bearing seats 50 at the outer ends of the holes 48 rockably receive the heads of hemispherical abutment plugs 52 that pass the shafts of the tension rods 46. Coil springs 54 positioned around the tension rods are compressed by washers 56 that are retained on the outer ends of the tension rods by retaining nuts 58.

A fuel injection tube 60 enters through plate 12 to the center of the space between the four rotors. The elliptical rotors 26–32 rotate in clockwise directions as indicated by the arrows 62 in FIG. 5. The beads 38 of the separator seals 36 seal the adjacent surfaces of the several rotors as they rotate, and the springs 54 and the tension rods 46 keep the beads 38 in sealing contact with the rotors. As is shown most clearly in FIG. 3, the tension rods 46 and separator seals rock through arcs 64 thus sealing the central combustion chamber 66 which varies in size and volume as the rotors rotate. The slanted grooves 40 in the inner edges of the cylindrical beads 38 on the separator seals 36 permit and encourage the swirling action of the combustion chamber gases so as to improve the combustion of such gases.

Figure 7:
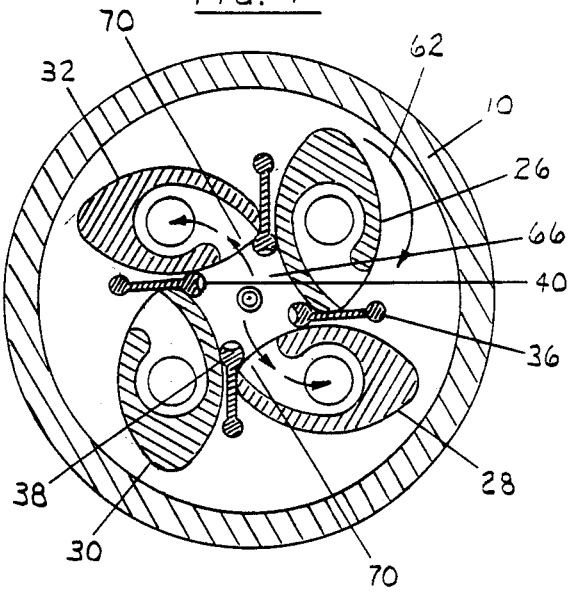
FIG. 7 is a transverse cross sectional view taken along the plane of the line 7—7 in FIG. 1 showing the rotors in a still further advanced position from that shown in FIG. 6.

All of the rotors 26–32 are of identical exterior elliptical cross section and are hollow, and all have ports along one of their surfaces adjacent apices of their major cross sectional axes. Rotors 26 and 30 are identical and have intake ports 68 which trail the leading apices of these two rotors. Rotors 28 and 32 have ports 70 which curve oppositely from the ports 68 and open to the combustion chamber 66 in advance of the leading apices of rotors 28 and 32. Ports 70 are exhaust ports from the combustion chamber 66 as shown in FIG. 7.

Figure 4:
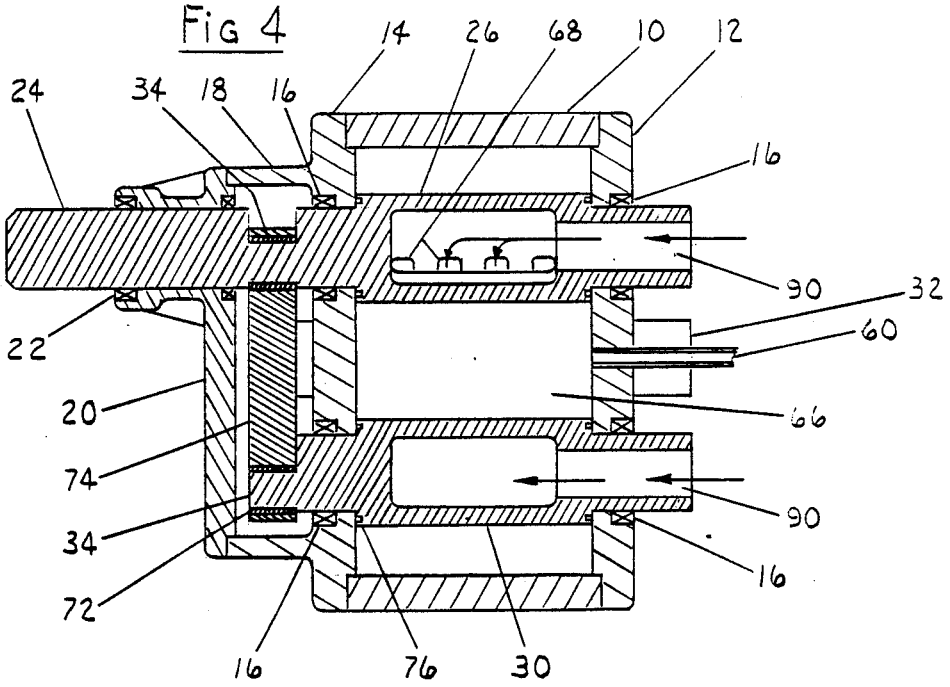
FIG. 4 is a longitudinal cross sectional view taken along the plane of the line 4—4 in FIG. 5 and looking in the direction of the arrows.
Figure 2:
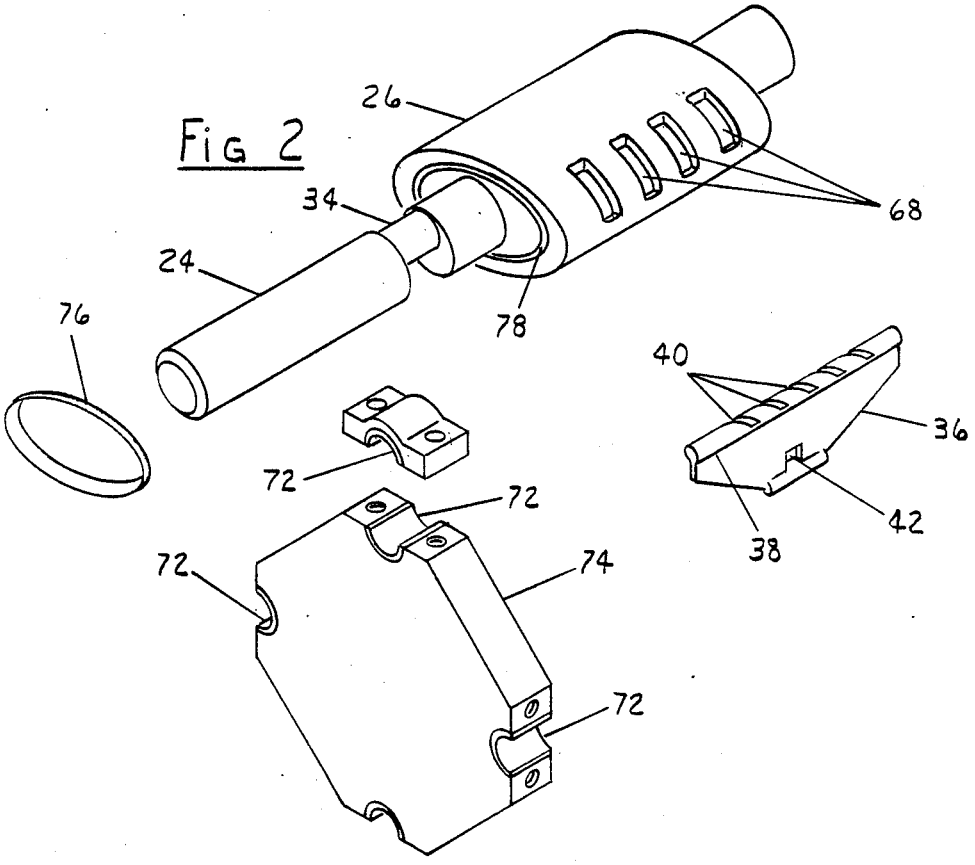
FIG. 2 is a perspective, disassembled view of one of the rotors, together with a connecting block and one of the end seals for the rotor and one of the separator seals that operate between adjacent rotors.

Turning to FIGS. 2 and 4, it will be seen that the crank pins 34 on the shafts in the crank case extension 18 are all received in bearings 72 carried by the corners of a connecting block 74. This assures synchronized rotation of all of the rotors.

Figure 8:
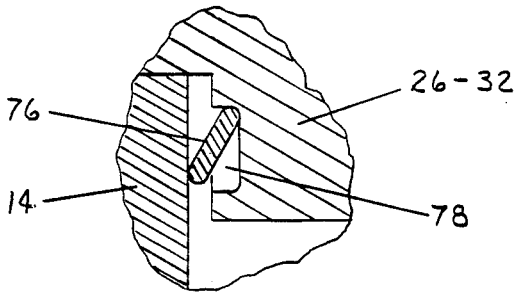
FIG. 8 is a fragmentary, enlarged, cross sectional view showing the detail of the rotor end seal shown in FIGS. 2 and 4.

The ends of the elliptical rotors are sealed to the inner surfaces of the end plates 12 and 14 by dished end seals 76 of elliptical contour. The end seals are received in mating elliptical grooves 78 in each end of each rotor and seal against the end plates. (See FIG. 8)

Figure 1:
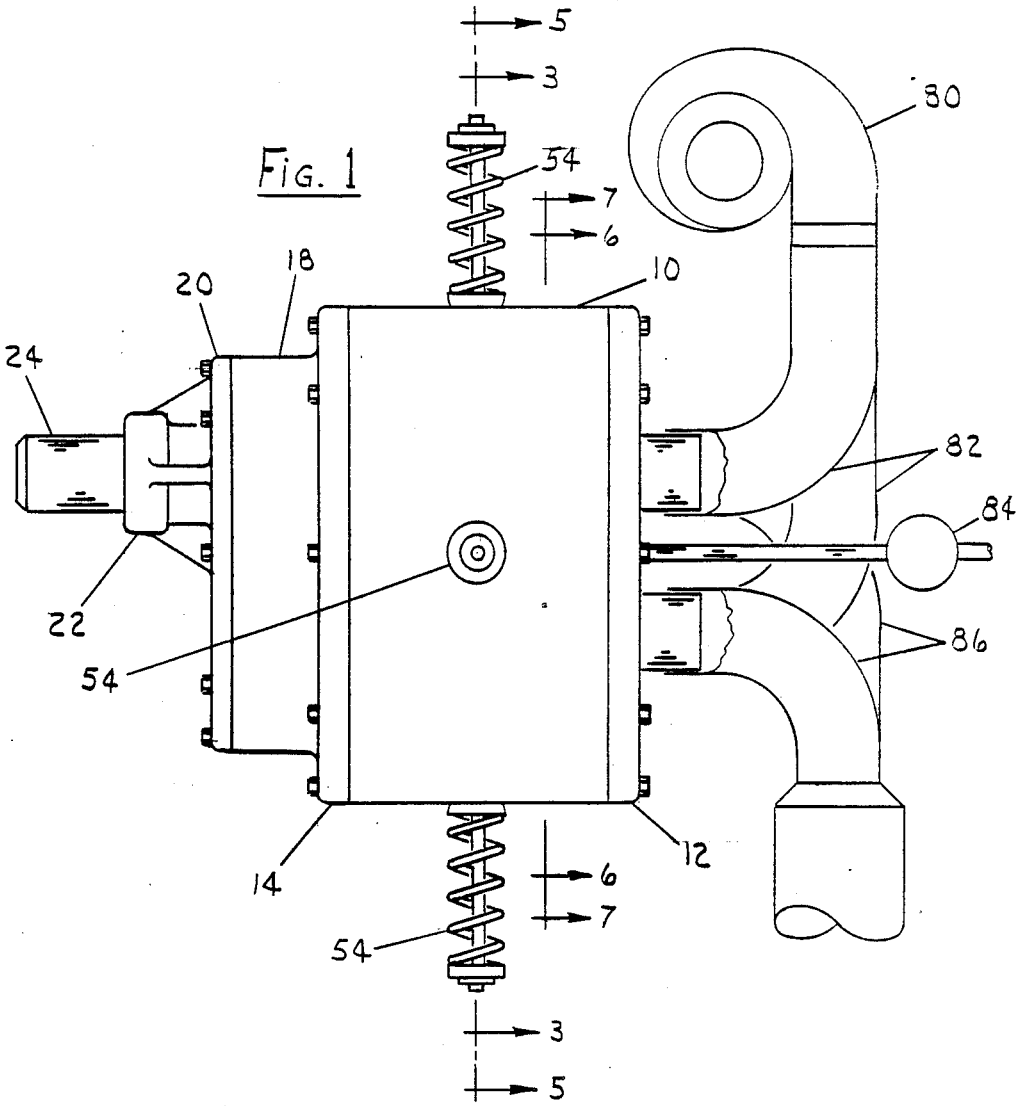
FIG. 1 is a side elevational view of the engine.

A blower 80 with connecting conduits 82 is conventionally illustrated in FIG. 1 for supplying air to the hollow centers 90 of rotors 26 and 30. A fuel injection pump 84 is conventionally illustrated at the end of the fuel injection pipe 60. Exhaust pipes from the ends of rotors 28 and 32 are shown at 86 in FIG. 1.

OPERATION

Figure 5:
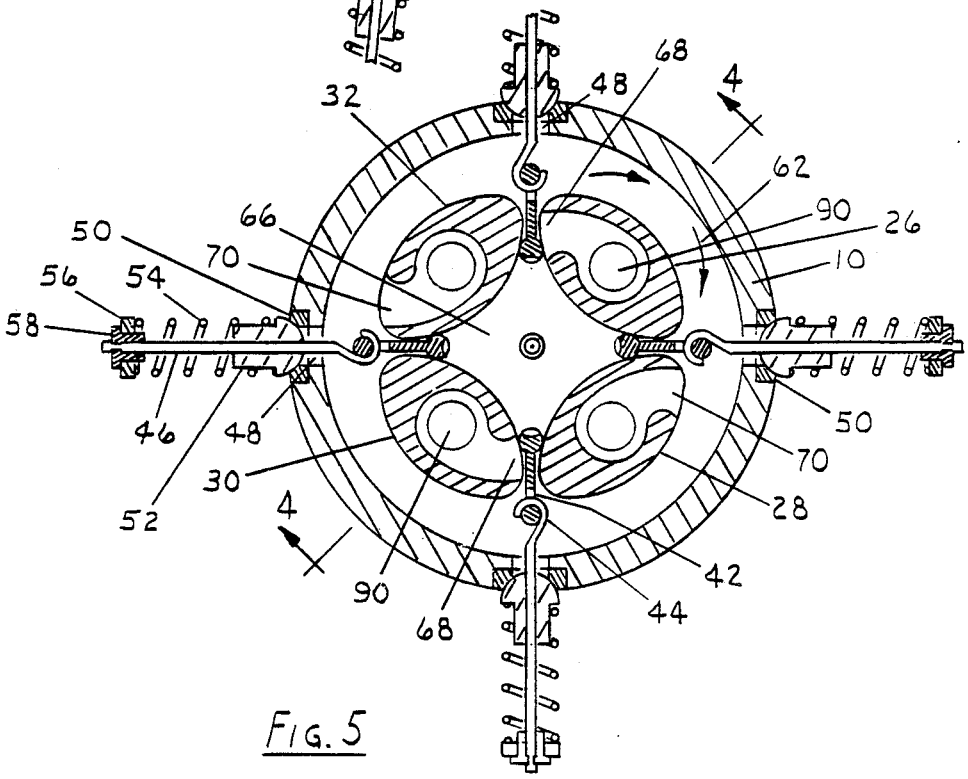
FIG. 5 is a transverse cross sectional view taken along the plane of the line 5—5 in FIG. 1 and looking in the direction of the arrows showing the rotors in a position advanced from that shown in FIG. 3.
Figure 6:
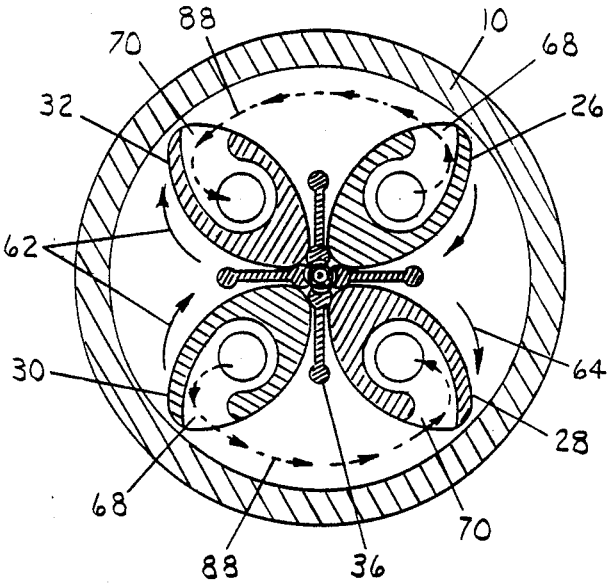
FIG. 6 is a transverse cross sectional view taken along the plane of the line 6—6 in FIG. 1 showing the rotors in a position advanced from those shown in FIGS. 3 and 5.

Starting with the rotors 26–28–30 and 32 as appearing in FIGS. 4 and 5, the intake ports 68 in rotors 26 and 30 are just closing the combustion chamber 66 which is at maximum volume. The exhaust ports 70 through the rotors 28 and 32 are fully open to the interior of the cylindrical body 10 and the ports 68 are opening to the same space in the interior of the casing. It is an important feature of this invention that this condition opens a flow path indicated by the dotted arrows 88 in FIG. 6. During the rotation of the rotors from the position shown in FIG. 6 this path is open so that incoming, cool, air can flow from the blower 80 through ducts 82 and through hollow shafts centers 90 to the interiors of rotors 26 and 30 and through their ports 68. From there the air flows through ports 70 in rotors 28 and 32 to the exhaust ducts 86. Cooling air flow is thus delivered through the hollow interiors of all of the rotors for approximately one quarter of each revolution of the rotors.

FIG. 7 illustrates the rotors at about the middle of the exhaust stroke with cross flow path 88 cut off but with exhaust continuing through rotors 28 and 32. FIG. 3 shows the rotors at mid-intake position with air entering through ports 68 from rotors 26 and 30. Air intake occurs for about 90 degree of rotation of the rotors until the maximum volume of chamber 66 is reached as in FIG. 5, after which compression takes place for about 90 degrees in FIG. 6 when fuel injection takes place and combustion and a power stroke condition exist for the last cycle of the rotor movement.

The rocking of the separator seals 36 is controlled by the compression of springs 54 on tension rods 46 holding the beads 38 in sealing engagement between adjacent rotors at all times.

What is claimed to be new and what is desired to be secured by Letters Patent is described in the following claims:

1. An internal combustion engine comprising a group of at least three elongated rotors having non-circular transverse cross sections and central shafts extensions on each end with the shaft extensions journalled in two end plates, at least two of said rotors having hollow interiors and one of the shaft extensions on each of said two hollow rotors forming an opening to the interior of their rotors, an outer body enclosing said group of rotors in spaced relation and closed on said end plates, means connecting the ends of the shaft extensions of said rotors exteriorly of an end plate for equal and simultaneous rotation, separator seals between adjacent rotors extending from end to end of the rotors and having enlarged beads on their inner edges, tension rods passing through said outer body from hook connections to said seals and tensioned to draw said beads against adjacent rotors, an outlet port formed through at least one of said hollow rotors in advance of the rotational direction of an apex of the rotor, an inlet port formed through another one of said hollow rotors in trailing relation to an apex of that rotor, and a fuel injector nozzle with an associated fuel pump projecting through one of said end plates to the space between said rotors.

2. An internal combustion engine as defined in claim 1 in which there are four similar hollow rotors with inlet ports formed through the sides of an opposed pair of said rotors and with outlet ports formed through the sides of the intervening pair of rotors.

3. An internal combustion engine as defined in claim 2 in which there are hemispherical seats formed in the wall of said outer body around said tension rods and abutment plugs around said tension rods with hemispherical heads pressed against said seats by springs surrounding said tension rods which holds the separator seals in sealing engagement between adjacent rotors at all times.

4. An internal combustion engine as defined in claim 2 in which there are non-circular grooves formed in the ends of said rotors adjacent to their peripherices and end seals of elliptical shape having truncated conical cross section compressed in said grooves by said end plates.

5. An internal combustion engine as defined in claim 2 in which said rotors are all of identical elliptical transverse cross section.

6. An internal combustion engine as defined in claim 2 in which the means connecting the ends of the shaft extensions on said rotors exteriorly of said body comprises crank pins on said shaft extensions received in bearings carried by a bearing block common to all said shaft extensions.

7. An internal combustion engine comprising a group of four elongated rotors having elliptical cross section with hollow interiors and central shaft extensions on each end with the shaft extensions journalled in two end plates, with a tubular body enclosing said group of rotors between said end plates and spaced from said rotors, one of said shaft extensions being adapted at its outer end to be connected as a drive shaft, means interconnecting said shaft extensions for simultaneous rotation, a first opposed pair of said rotors defining intake ports through their sides in trailing relation to apices of their cross sectional axes, the other opposed pair of rotors defining outlet ports through their sides in leading relation to apices of their cross sectional case axes, inlet ducts formed through shaft extensions of said first pair of rotors, outlet ducts formed through shaft extensions of said other of said pair of rotors and opening exteriorly of said end plates, blower means connected to deliver air to said inlet ducts, fuel injection means connected to deliver to the space between said rotors, and separator seals extending from end to end of said rotors and therebetween fitted in sliding contact between adjacent rotors.

8. An internal combustion engine as defined in claim 7 in which said means interconnecting said shaft extensions comprises crank pins on said shaft extensions, and a common connector block having bearings rotatably receiving said crank pins.

9. An internal combustion engine as defined in claim 8 in which there are sealing end seals of elliptical shape having truncated conical cross section compressed into elliptical grooves in the ends of said rotors by said end plates.

10. An internal combustion engine as defined in claim 7 in which there are slanted grooves in the inner edges of the enlarged beads of the separator seals to encourage the swirling action of the combustion chamber gases.

* * * * *